US006330421B1

(12) United States Patent
Park et al.

(10) Patent No.: US 6,330,421 B1
(45) Date of Patent: Dec. 11, 2001

(54) APPARATUS FOR DISSOLVING RESIDUAL TONER FROM A TRANSFER ROLLER AND A PHOTORECEPTOR BELT OF A LIQUID ELECTROPHOTOGRAPHIC PRINTER UPON PRINTING OF A SHEET/USER ACTUATION

(75) Inventors: Woo-Young Park, Suwon (KR); David Charles Hogan, Fairport, NY (US); Moon-Bae Park, Suwon (KR)

(73) Assignee: Samsung Electronics Co., Ltd, Suwon (KR)

( * ) Notice: Subject to any disclaimer, the term of this patent is extended or adjusted under 35 U.S.C. 154(b) by 0 days.

(21) Appl. No.: 09/594,157

(22) Filed: Jun. 15, 2000

(30) Foreign Application Priority Data

Jun. 16, 1999 (KR) ..... 99-22508

(51) Int. Cl.[7] ..... G03G 15/20; G03G 21/00
(52) U.S. Cl. ..... 399/348; 399/327
(58) Field of Search ..... 399/307, 327, 399/345, 346, 348

(56) References Cited

U.S. PATENT DOCUMENTS 4,541,707 * 9/1985 Yoshinaga ..... 399/327 X
4,705,388 * 11/1987 Huntjens et al. ..... 399/327 X
5,546,174 * 8/1996 Hashizume et al. ..... 399/327
5,768,672 * 6/1998 van Herpen et al. ..... 399/327
5,911,101 * 6/1999 Park ..... 399/348 X
6,026,271 * 2/2000 Saitoh ..... 399/345 X
6,035,176 * 3/2000 Byeon ..... 399/345
6,060,205 * 5/2000 Takeichi et al. ..... 399/346 X

* cited by examiner

*Primary Examiner*—Fred L Braun
(74) *Attorney, Agent, or Firm*—Robert E. Bushnell, Esq.

(57) ABSTRACT

A pair of cleaning apparatuses for a liquid electrophotographic printer that can completely remove to residual toner from both a photo receptor belt and a transfer roller, respectively. Each cleaning apparatus is supplied with a liquid solvent used to dissolve toner remaining on the transfer roller and the photo receptor belt after a printing operation. Each of the pair of cleaning apparatuses can engage and disengage to and from the photo receptor belt and the transfer roller respectively upon user actuation or entry of a sheet of recording media into the electrophotographic printing apparatus. Each cleaning apparatus contains in rectangular felt material soaked with solvent positioned to mate with the surfaces of the photo receptor belt and the transfer roller.

16 Claims, 12 Drawing Sheets

APPARATUS FOR DISSOLVING RESIDUAL TONER FROM A TRANSFER ROLLER AND A PHOTORECEPTOR BELT OF A LIQUID ELECTROPHOTOGRAPHIC PRINTER UPON PRINTING OF A SHEET/USER ACTUATION

BACKGROUND OF THE INVENTION

1. Field of the Invention

The present invention relates to a liquid electrophotographic printer, and more particularly, to a cleaning apparatus for removing various contaminants containing untransferred toner remaining on a photoreceptor belt and/or a transfer roller after printing, using a cleaning member having a solvent, and a liquid electrophotographic printer having the cleaning apparatus.

Here, printers generally refer to all kinds of image printing apparatuses for printing an image using an electrophotographic process, for example, copiers, facsimile apparatuses or the like, as well as general laser printers.

2. Description of the Related Art

In general, a liquid electrophotographic printer forms an electrostatic latent image on a photosensitive medium such as a photoreceptor belt by scanning a laser beam onto the photoreceptor belt, develops the electrostatic latent image formed on the photoreceptor belt using a developer liquid, which is a mixture of solid toner of a predetermined color and liquid carrier serving as a solvent, and transfers the developed image to a printing sheet, thereby printing a desired image.

The liquid electrophotographic printer typically have two parts; an engine which consists of essential parts for performing a printing process, and a controller for interpreting data transmitted from a data outputting device such as a computer, constructing to-be-printed image data by individual bits of a one-page size to then be stored in a video RAM, communicating with the engine so as to perform printing and then transmitting the data stored in the video RAM to the engine in the form of serial data.

An exemplary liquid electrophotographic printer having the aforementioned configuration is schematically shown in FIG. 1, which will now be described briefly.

As illustrated, the liquid electrophotographic printer includes a photoreceptor belt 10 wound around and supported by rollers 1, 2 and 3 which are installed within a printer body and traveling along a predetermined track.

In the neighborhood of the photoreceptor belt 10 are installed an erasure unit 20 for erasing the surface potential formed on the photoreceptor belt 10, a charging unit 30 for charging the photoreceptor belt 10 from which the surface potential has been erased, to a predetermined potential, an exposure unit 40 for forming an electrostatic latent image by scanning a laser beam converted according to electric data of a portion to be printed, onto the photoreceptor belt 10, a development unit 50 for supplying a developer liquid, which is a mixture of solid toner and liquid carrier, to the photoreceptor belt 10 to thus adhere the toner to a portion of the surface of the photoreceptor belt 10 where the electrostatic latent image is formed, thereby forming a visible image, a drying unit 60 for absorbing only the carrier contained in the developer liquid other than the toner adhered to the photoreceptor belt 10, drying and removing the same, a transfer/fixation unit 70 for transferring the toner formed on the photoreceptor belt 10 as an image, to a printing sheet 80.

Inside the photoreceptor belt 10 are installed a plurality of backup rollers 4, 5, 6 and 7 in close contact with the photoreceptor belt 10 to then be passively driven.

Also, the exposure unit 40 includes four laser scanning units (LSUs) 41, 42, 43 and 44 corresponding to various colors, for example, yellow (Y), magenta (M), cyan (C) and black (K), respectively.

The development unit 50 includes four development rollers 51, 52, 53 and 54 rotating selectively in close contact with the photoreceptor belt 10, and squeegee rollers 51', 52', 53' and 54' installed next to the development rollers 51, 52, 53 and 54, respectively.

The drying unit 60 includes a dry roller 62 rotatably installed in a bracket (not shown) provided inside a manifold 61, and a pair of heating rollers 63 and 63' selectively in close contact with the dry roller 62.

The transfer/fixation unit 70 includes a transfer roller 71 selectively brought into close contact with the photoreceptor belt 10, and a fixation roller 72 selectively brought into close contact with the transfer roller 71. The printing sheet is fed between the transfer roller 71 and the fixation roller 72. At this stage, the image transferred to the transfer roller 71 is conveyed to the printing sheet 80. The fixation roller 72 fuses the toner image to then be adhered to the printing sheet 80 by applying heat and pressure to the toner image conveyed to the printing sheet.

Although not shown, the liquid electrophotographic printer further includes a developer liquid supplying device for continuously supplying a developer liquid having a predetermined concentration to the development unit 50, a sheet feeding unit for supplying printing sheets and a sheet ejection unit.

The printing process of the aforementioned liquid electrophotographic printer is performed as follows.

If a printing instruction is input from a data outputting device such as a computer, the erasure unit 20 first operates to electrically clear the residual charges remaining on the photoreceptor belt 10. Then, the charging unit 30 applies a high voltage to the photoreceptor belt 10 to charge the surface thereof to a predetermined potential (generally 500 to 700 V).

Next, the exposure unit 40 scans a laser beam converted according to the electric data of a portion to be printed on the photoreceptor belt 10 charged to the predetermined potential, thereby forming an electrostatic latent image on the photoreceptor belt 10 due to a difference in the surface potential.

After exposure, the development unit 50 performs development, in which the electrostatic latent image formed on the photoreceptor belt 10 is converted into a visible image using toner particles. The development unit 50 adheres the toner contained in an externally supplied developer liquid to the portion of the photoreceptor belt 10 where the electrostatic latent image is formed, thereby forming the visible image on the photoreceptor belt 10. Here, the liquid carrier contained in the developer liquid is squeezed simultaneously with development to then be primarily separated for removal.

The surplus carrier which is not removed by the development unit 50 is absorbed by the dry roller 62 while the photoreceptor belt 10 passes through the drying unit 60, and then evaporated by a pair of heating rollers 63 and 63' for removal, so that the toner image formed on the photoreceptor belt 10 becomes a suitable image to be transferred.

The toner image developed on the photoreceptor belt 10 through the above-described process is transferred to the transfer roller 71 via the transfer/fixation unit 70. The image transferred to the transfer roller 71 is conveyed to the printing sheet 80 fed between the transfer roller 71 and the fixation roller 72, and are completely fused to then be fixed to the printing sheet 80 when heat and pressure are applied by the fixation roller 72.

During the above-described process, transferring an image, for example, from the photoreceptor 10 to the transfer roller 71 or from the transfer roller 71 to the printing sheet 80, is performed due to a difference in the surface energy, that is, a difference in the adhesion, between each of the photoreceptor belt 10, the transfer roller 71 and the printing sheet 80. In other words, since the adhesion of the photoreceptor belt 10 is set to be relatively higher than that of the transfer roller 71, and the adhesion of the printing sheet 80 is set to be higher than that of the transfer roller 71, the toner image of the photoreceptor belt 10 is transferred to the transfer roller 71 and is finally transferred to the printing sheet 80.

Here, it is desirable that the image of the photoreceptor belt 10 is completely transferred to the transfer roller 71 and that the image of the transfer roller 71 is completely transferred to the printing sheet 80. However, in an actual printing process, the adhesion between the photoreceptor belt 10 and the transfer roller 71 and the adhesion between the transfer roller 71 and the printing sheet 80 are not maintained at appropriate levels. Thus, some of the image of the photoreceptor belt 10 may remain on the photoreceptor belt 10, without being completely transferred to the transfer roller 71. Also, some of the image of the transfer roller 71 may remain on the transfer roller 71, without being completely transferred to the printing sheet 80.

As described above, in the case where untransferred toner remains on the photoreceptor belt 10, the toner may overlap with an image to be printed next, resulting in deterioration of picture quality. Also, if the untransferred toner is hardened on the photoreceptor belt, the portion of the photoreceptor belt bearing hardened toner cannot be used, which unavoidably causes deterioration of picture quality. Also, the toner remaining on the photoreceptor belt is used in development of a subsequent image to thus contaminate ink and also causes contamination to the dry roller. Thus, the untransferred toner remaining on the photoreceptor belt must be removed.

The aforementioned problems may also be encountered in the case where untransferred toner remains on the transfer roller 71. Moreover, since the contamination of the transfer roller 71 may adversely affect picture quality, the contamination of the transfer roller 71 must be eliminated.

To this end, in the conventional printer, as shown in FIG. 1, there is provided a cleaning apparatus for removing ink sludge sticking to or remaining on the transfer roller 71, by installing a separate cleaning roller 90 in the neighborhood of the transfer roller 71 to be selectively brought into close contact with the transfer roller 71. This cleaning apparatus can also be used for cleaning the photoreceptor belt 10 in the following manner.

That is to say, after printing, the fixation roller 72 is separated from the transfer roller 71 and then the untransferred toner remaining on the photoreceptor belt 10 is made to be transferred to the transfer roller 71 while operating the cleaning roller 90 in close contact with the transfer roller 71. Then, the transfer roller 71 is cleaned using the cleaning roller 90, thereby removing the contaminants, that is, untransferred toner, of the photoreceptor belt 10.

However, the aforementioned cleaning apparatus of a general liquid electrophotographic printer, which is configured such that untransferred toner remaining on a photoreceptor belt is first transferred to a transfer roller and the contaminants transferred to the transfer roller are then removed, has a problem in that there is a limit in removing the contamination of the photoreceptor belt, that is, the toner which is not transferred from the photoreceptor belt to the transfer roller during a cleaning process, cannot be removed.

Also, since the conventional cleaning apparatus is a dry type in which the surface of a transfer roller is wiped out by simply bringing a cleaning roller into close contact with the transfer roller, the contaminants containing untransferred toner remaining on a photoreceptor belt are not completely removed. Also, the adhesion of the transfer roller may be weakened so that the untransferred toner on the photoreceptor belt cannot be transferred to the transfer roller, thereby obstructing effective removal of contaminants of the photoreceptor belt.

Further, since the conventional cleaning apparatus is configured to remove contaminants of a photoreceptor belt by being driven in a separate cleaning mode after printing, a separate cleaning time is required. Thus, the overall time required for printing increases. Also, since the contamination of the photoreceptor belt cannot be removed during a continuous printing process, the deterioration of picture quality, which is due to contamination of the photoreceptor belt, cannot be avoided.

SUMMARY OF THE INVENTION

To solve the above problems, it is a first object of the present invention to provide a cleaning apparatus of a liquid electrophotographic printer which can effectively remove various contaminants containing untransferred toner remaining on a photoreceptor belt, by performing a cleaning operation in direct contact with the photoreceptor belt.

It is a second object of the present invention to provide a cleaning apparatus of a liquid electrophotographic printer which can dissolve untransferred toner remaining on a photoreceptor belt and on a transfer roller and completely remove the same, by bringing a cleaning member containing a liquid solvent into contact with the photoreceptor belt and the transfer roller.

It is a third object of the present invention to provide a cleaning apparatus of a liquid electrophotographic printer which can reduce a printing time by continuously performing a cleaning operation such that the cleaning apparatus is brought into contact with a photoreceptor belt simultaneously with printing by the printer, without a separate cleaning time being required, and which can effectively remove various contaminants containing untransferred toner remaining on the photoreceptor belt even while the printing is continuously performed.

It is a fourth object of the present invention to provide a liquid electrophotographic printer having the cleaning apparatus, by which deterioration of picture quality due to contamination of a photoreceptor belt and a transfer roller can be prevented and a clean picture image can be obtained.

To solve the above objects of the present invention, there is provided a cleaning apparatus of a liquid electrophotographic printer includes a photoreceptor belt contamination removing means which is brought into close contact with the surface of the photoreceptor belt simultaneously with a printing operation, for removing contaminants containing untransferred toner of the photoreceptor belt, and a transfer roller contamination removing means which is brought into close contact with the surface of the transfer roller simultaneously with a printing operation, for removing contaminants containing untransferred toner of the transfer roller.

Here, the photoreceptor belt contamination removing means is installed between a transfer/fixation unit and a charging unit in the neighborhood of a photoreceptor belt of the liquid electrophotographic printer.

Also, the cleaning apparatus may further include a solvent supplying means for continuously supplying a solvent to the photoreceptor belt contamination removing means and the transfer roller contamination removing means so that the respective contamination removing means containing the solvent dissolve the untransferred toner to then be removed. Accordingly, the contaminants containing untransferred toner of the photoreceptor belt and the transfer roller can be more effectively removed.

The photoreceptor belt contamination removing means preferably includes a cleaning member assembly selectively brought into close contact with the surface of the photoreceptor belt, for wiping out the contaminants of the photoreceptor belt, a housing for supporting the cleaning member assembly, a means for making the cleaning member assembly closely contact and/or separate from the surface of the photoreceptor belt by moving the cleaning member assembly relative to the housing, and a frame fixed to the printer body, for detachably supporting the housing.

The cleaning member assembly includes a cleaning member, a pair of fixing blocks coupled to both ends of the cleaning member and a bracket integrally coupled to the pair of fixing blocks.

Here, the cleaning member is formed by stacking a plurality of thin rectangular felts on a fixing plate having a pair of fixing pieces, and a cleaning sheet, which is brought into direct contact with the photoreceptor belt during a cleaning operation, is fixed to the bottom surface of the cleaning member. Also, a pair of fixing pieces are formed at both ends of the fixing plate.

Also, fixing parts for fixing the fixing pieces of the cleaning member and threaded holes piercing downward, are formed in the fixing blocks, respectively. Springs for elastically supporting the pair of fixing blocks downward with respect to the housing are installed in the threaded holes. Further, adjustment threads are upwardly engaged with the threaded holes, for supporting the springs and adjusting the elasticity thereof.

The cleaning member contacting and separating means may include a movement shaft installed to be capable of moving axially through the openings formed on the fixing blocks, a plurality of operating protrusions protruding at three or more locations of the movement shaft in the radial direction thereof, and cam grooves each having a predetermined inclined portion, formed on one side of the holder bracket. If the movement shaft is axially moved, the cleaning member assembly ascends or descends with respect to the housing by the action of the operating protrusions and the cam grooves of the holder bracket. Accordingly, the cleaning member assembly can closely contact and/or separate from the photoreceptor belt.

Circular holes into which the movement shaft is inserted are formed at both ends of the housing, respectively, and guiding slots for guiding movement of the operating protrusions piercing cam grooves of the bracket and protruding are formed at locations corresponding to the cam grooves on the rear surface of the housing. Also, guide rails are formed on the front and rear surfaces of the housing and slide grooves into which the guide rails of the housing are inserted, are formed in the frame. Thus, the housing can be detachably installed in the frame.

The transfer roller contamination removing means may include a cleaning member assembly selectively brought into close contact with the transfer roller, for wiping out the contaminants of the transfer roller, a frame fixed to a printer body and having each pair of first and second guiding holes formed on its top surface and guiding slots formed at either lateral side thereof, for supporting the cleaning member assembly, and a means for making the cleaning member assembly closely contact and/or separate from the transfer roller by moving the cleaning member assembly relative to the frame.

The cleaning member assembly includes a cleaning member formed by stacking a plurality of thin rectangular felts having different heights and having an arcuate lower profile corresponding to the outer circumferential surface of the transfer roller, formed under the stack of the felts, a holder for fixing the cleaning member and having guiding protrusions inserted into guiding slots of the frame, and a holder bracket integrally coupled to the holder and having on the top surface thereof a pair of guide bars piercing a pair of first guiding holes formed on the frame.

Also, the cleaning member contacting and separating means may include a pair of movement bars piercing the second guiding holes to then be fixed to the holder bracket at both ends thereof, springs interposed between the pair of movement bars, for elastically supporting the holder bracket downward with respect to the frame, and a movement lever movably installed to be capable of rotating relative to the movement bars upward protruding with respect to the frame by means of a pin. Here, if the movement lever is rotated in one direction, it gets laid down with respect to the frame so that the holder bracket is pushed by the springs and the cleaning member is brought into close contact with the transfer roller accordingly. If the movement lever is rotated in a reverse direction, it erects with respect to the frame so that the holder bracket is pulled toward the frame in spite of the elasticity of the springs and the cleaning member is separated from the transfer roller accordingly.

The solvent supplying means may include a solvent storage tank installed at one side of the printer body, for storing a solvent, and a solvent conveying member installed to be led from the solvent storage tank to be connected to the photoreceptor belt contamination removing means and the transfer roller contamination removing means, for continuously conveying the solvent stored in the solvent storage tank to the cleaning members of the respective contamination removing means.

Accordingly, since the photoreceptor belt is cleaned by the cleaning member in direct contact with the surface of the rotating photoreceptor belt, various contaminants containing untransferred toner which is not transferred to the transfer roller and remains on the photoreceptor belt can be effectively removed.

Further, since the photoreceptor belt and the transfer roller are cleaned by the cleaning members containing the solvent which are in close contact with the photoreceptor belt and the transfer roller, various contaminants containing untransferred toner remaining on the photoreceptor belt and the transfer roller can be perfectly removed.

According to another aspect of the present invention, there is provided a liquid electrophotographic printer including a photoreceptor belt wound around and supported by a plurality of rollers which are installed within a printer body and traveling along a predetermined track, a charging unit for charging the surface potential erased photoreceptor belt to a predetermined potential, an exposure unit for forming an electrostatic latent image on the photoreceptor belt by scanning onto the photoreceptor belt a laser beam converted according to electric data of a portion to be printed, a development unit for supplying a developer liquid which is a mixture of solid toner and liquid carrier to the photoreceptor belt to adhere the toner to a portion on the surface of the photoreceptor belt where the electrostatic latent image is formed, thereby forming a visible image, a drying unit for absorbing, drying and removing only the carrier contained in the developer liquid other than the toner adhered to the photoreceptor belt, a transfer/fixation unit for transferring the toner formed on the photoreceptor belt as an image to a printing sheet, a photoreceptor belt contamination removing means installed between a transfer/fixation unit and a charging unit in the neighborhood of a photoreceptor belt of the liquid electrophotographic printer to be brought into close contact with the surface of the photoreceptor belt simultaneously with a printing operation, for removing contaminants containing untransferred toner of the photoreceptor belt, a transfer roller contamination removing means installed in the neighborhood of the transfer/fixation unit to be brought into close contact with the surface of the transfer roller simultaneously with a printing operation, for removing contaminants containing untransferred toner of the transfer roller, and a solvent supplying means for continuously supplying a solvent to the photoreceptor belt contamination removing means and the transfer roller contamination removing means so that the respective contamination removing means containing the solvent dissolve the untransferred toner to then be removed.

The photoreceptor belt contamination removing means may include a cleaning member assembly selectively brought into close contact with the surface of the photoreceptor belt, for wiping out the contaminants of the photoreceptor belt, a housing for supporting the cleaning member assembly, a means for making the cleaning member assembly closely contact and/or separate from the surface of the photoreceptor belt by moving the cleaning member assembly relative to the housing, and a frame fixed to the printer body, for detachably supporting the housing.

The transfer roller contamination removing means may include a cleaning member assembly selectively brought into close contact with the transfer roller, for wiping out the contaminants of the transfer roller, a frame fixed to a printer body and having each, for and supporting the cleaning member assembly, and a means for making the cleaning member assembly closely contact and/or separate from the transfer roller by moving the cleaning member assembly relative to the frame.

The solvent supplying means may include a solvent storage tank installed at one side of the printer body, for storing a solvent, and a solvent conveying member installed to be led from the solvent storage tank to be connected to the photoreceptor belt contamination removing means and the transfer roller contamination removing means, for continuously conveying the solvent stored in the solvent storage tank to the cleaning members of the respective contamination removing means.

As described above, in the liquid electrophotographic printer according to the present invention, simultaneously with printing, a cleaning member containing a solvent closely contacts a photoreceptor belt to thus continuously clean the photoreceptor belt, and another cleaning member containing a solvent cleans a transfer roller in close contact with the photoreceptor belt. Thus, the contamination of the photoreceptor belt and the transfer roller can be effectively removed even during a continuous printing process, thereby preventing deterioration of picture quality and print inferiority due to contamination of the photoreceptor belt and transfer roller, and obtaining a clean picture image.

BRIEF DESCRIPTION OF THE DRAWINGS

The above object and other advantages of the present invention will become more apparent by describing in detail a preferred embodiment thereof with reference to the attached drawings in which.

DESCRIPTION OF THE PREFERRED EMBODIMENTS

Figure 1:
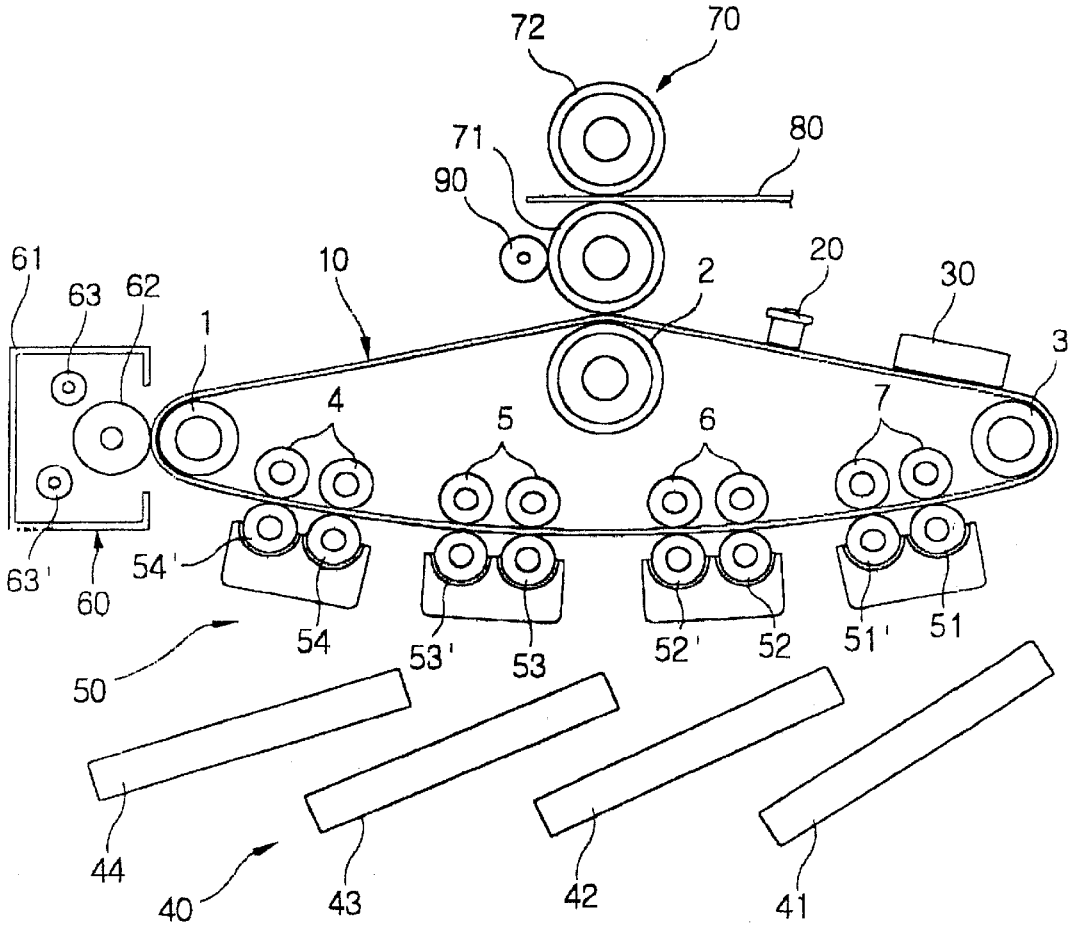
FIG. 1 (PRIOR ART)
FIG. 1 is a schematic diagram illustrating major parts of a general liquid electrophotographic printer.
Figure 2:
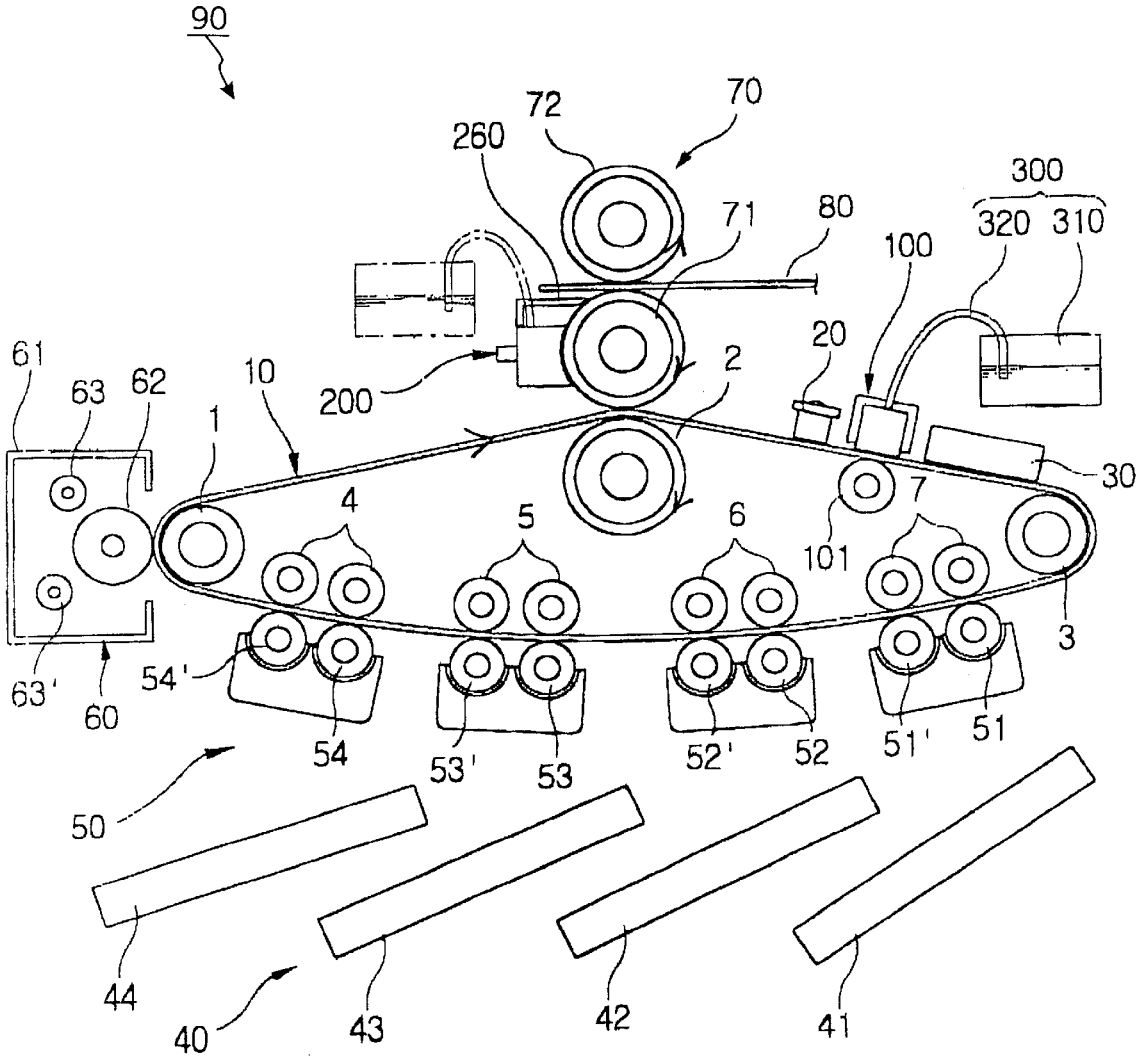
FIG. 2 is a schematic diagram illustrating major parts of a liquid electrophotographic printer employing a cleaning apparatus according to a preferred embodiment of the present invention.
Figure 3:
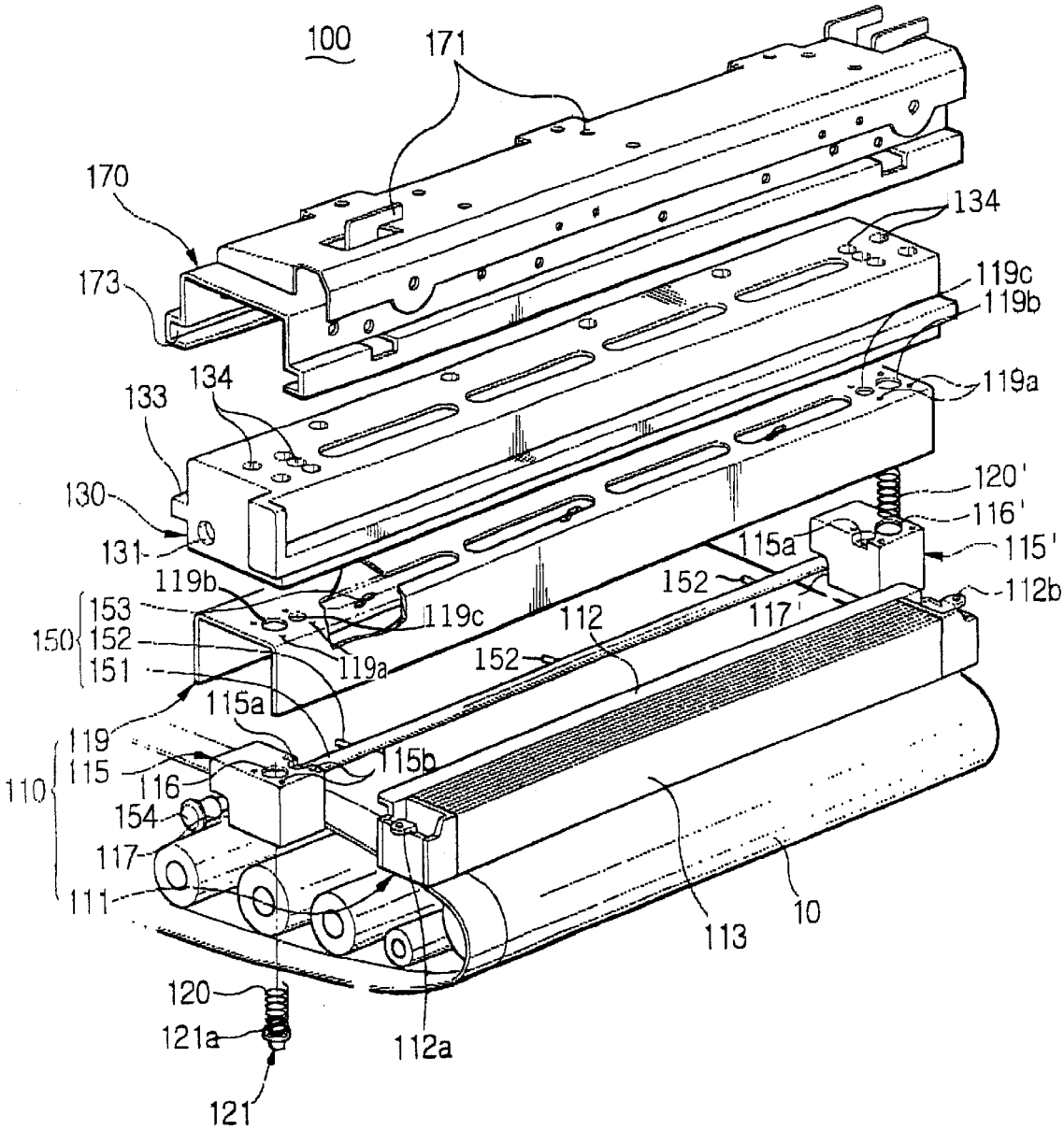
FIG. 3 is an exploded perspective view illustrating the structure of a photoreceptor belt contamination removing means shown in FIG. 2.
Figure 4:
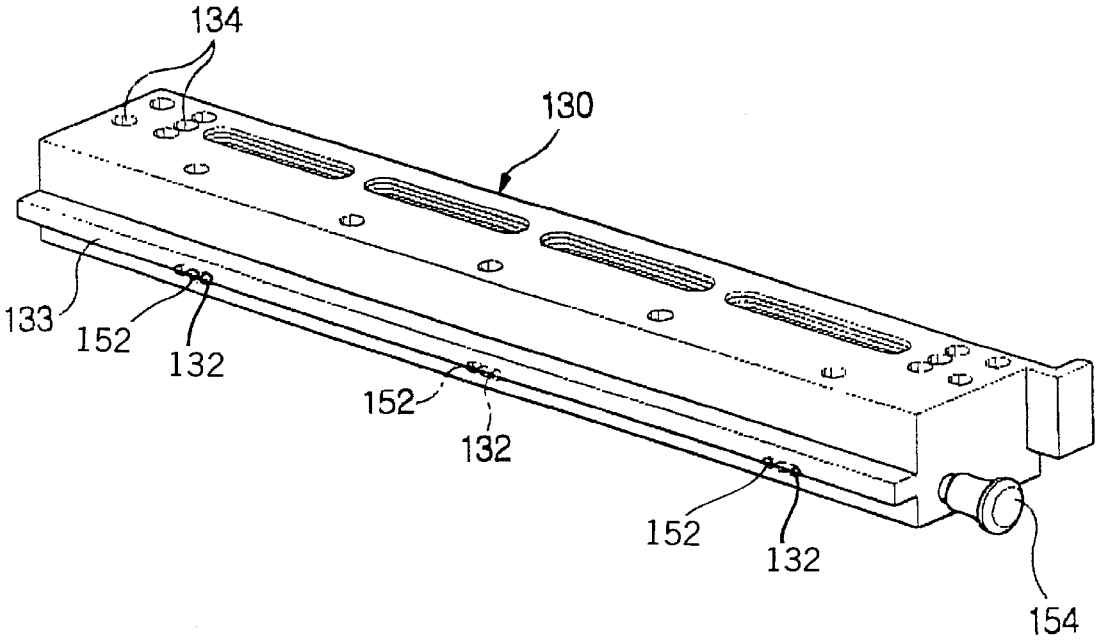
FIG. 4 is a perspective view showing the assembled state of FIG. 3.
Figure 5:
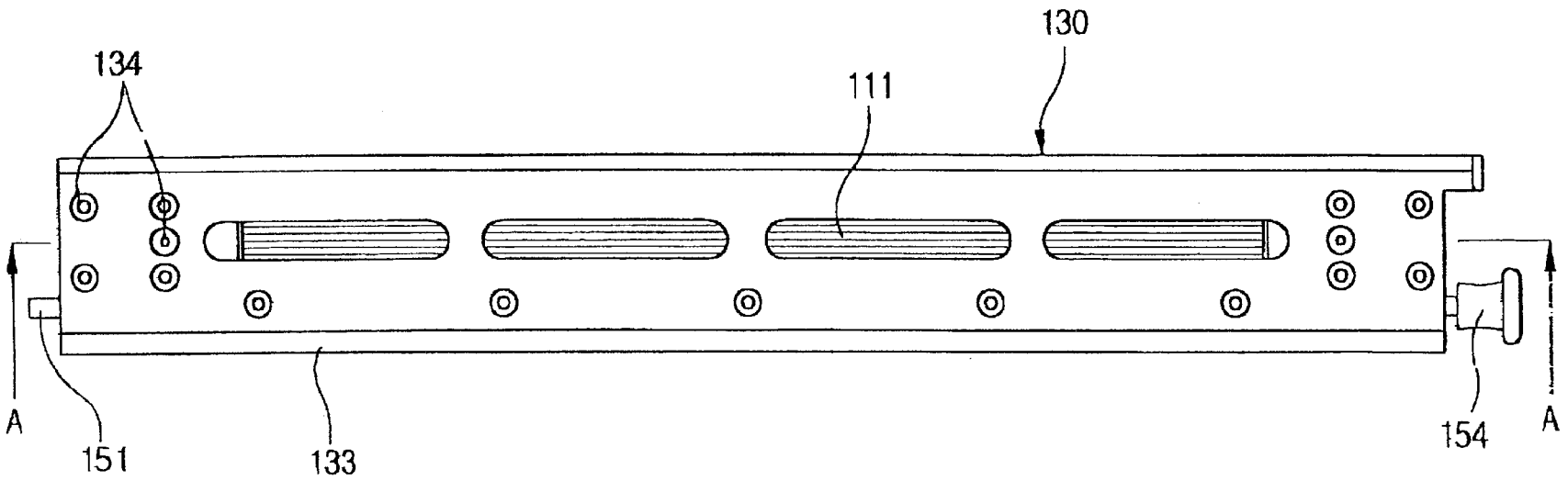
FIG. 5 is a plan view of FIG. 4.
Figure 6:
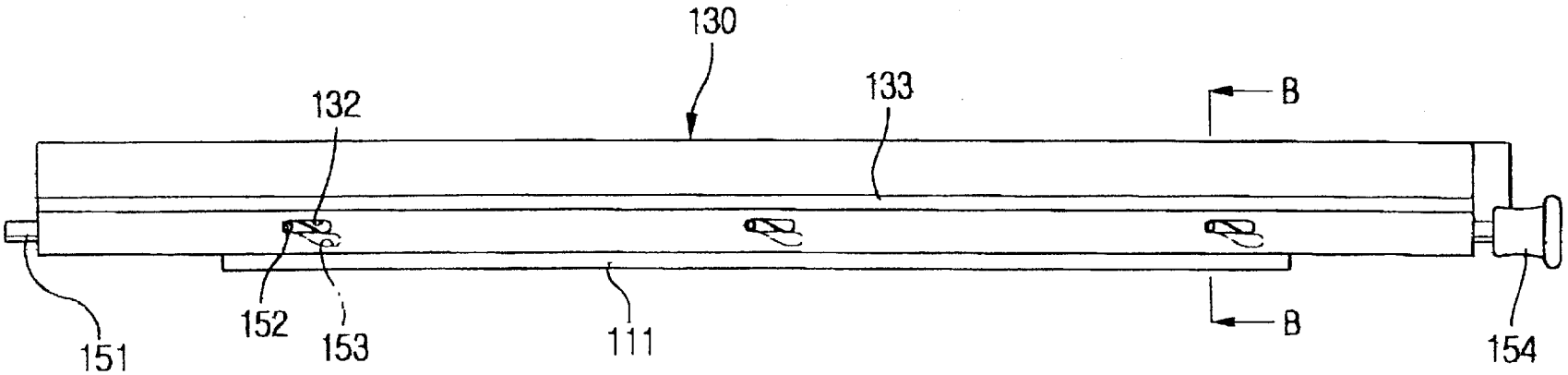
FIG. 6 is a front view of FIG. 4.
Figure 7:
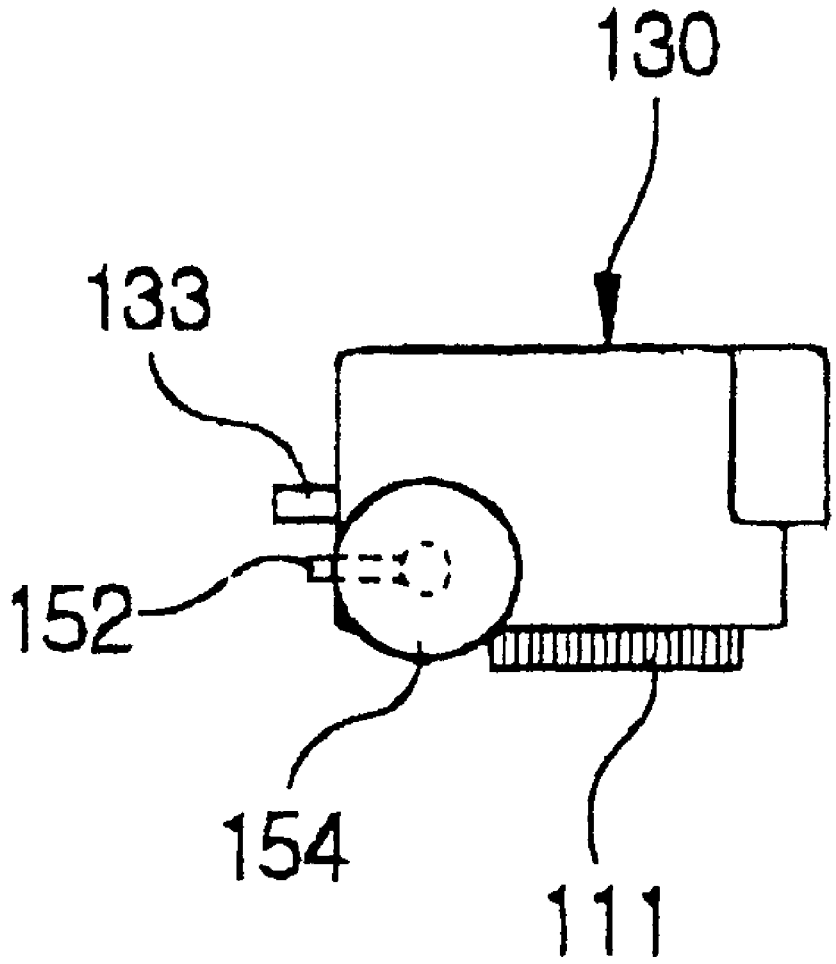
FIG. 7 is a side view of FIG. 4.
Figure 8:
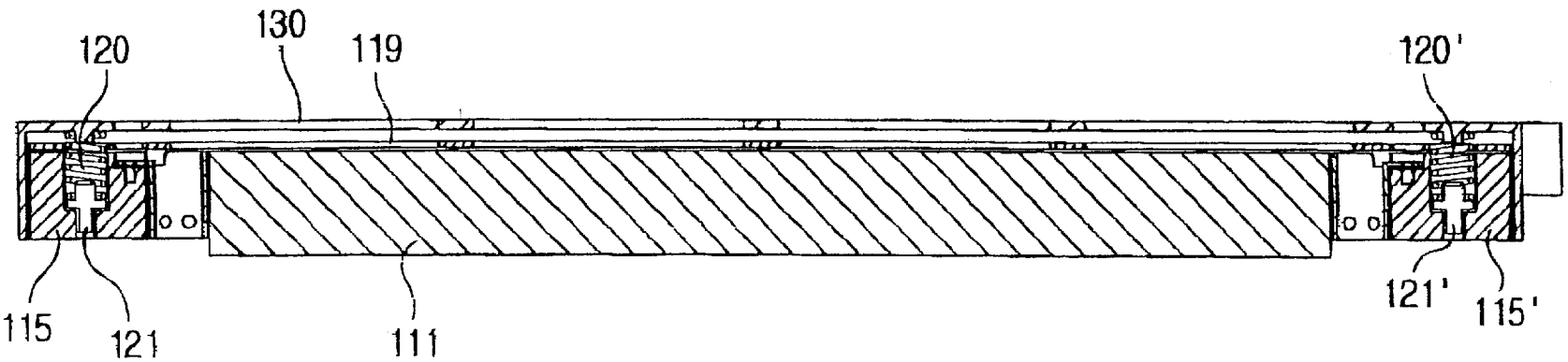
FIG. 8 is a cross-sectional view taken along the line A—A of FIG. 5.
Figure 9A:
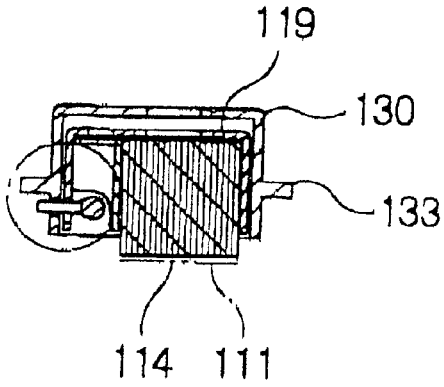
FIG. 9A is a cross-sectional view taken along the line B—B of FIG. 6.
Figure 9B:
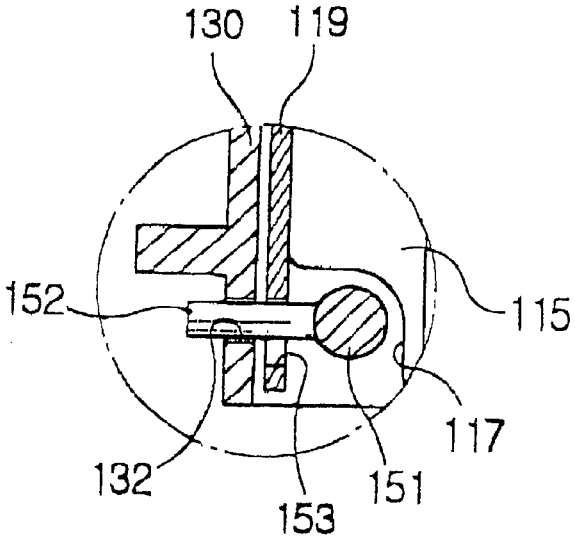
FIG. 9B is a detailed diagram illustrating major parts shown in FIG. 9A.
Figure 10:
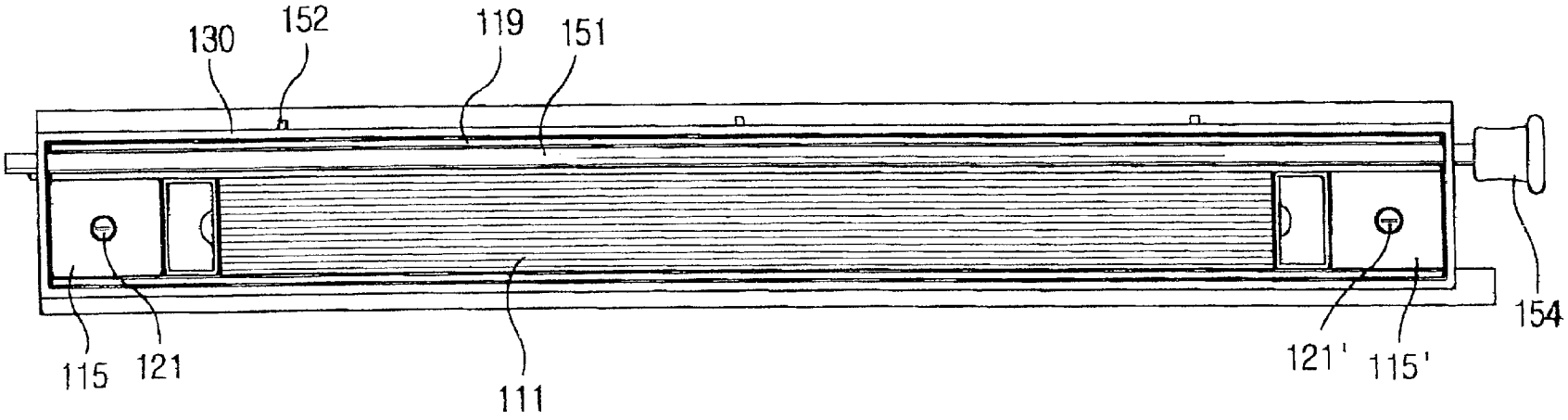
FIG. 10 is a bottom view of FIG. 5.
Figure 11:
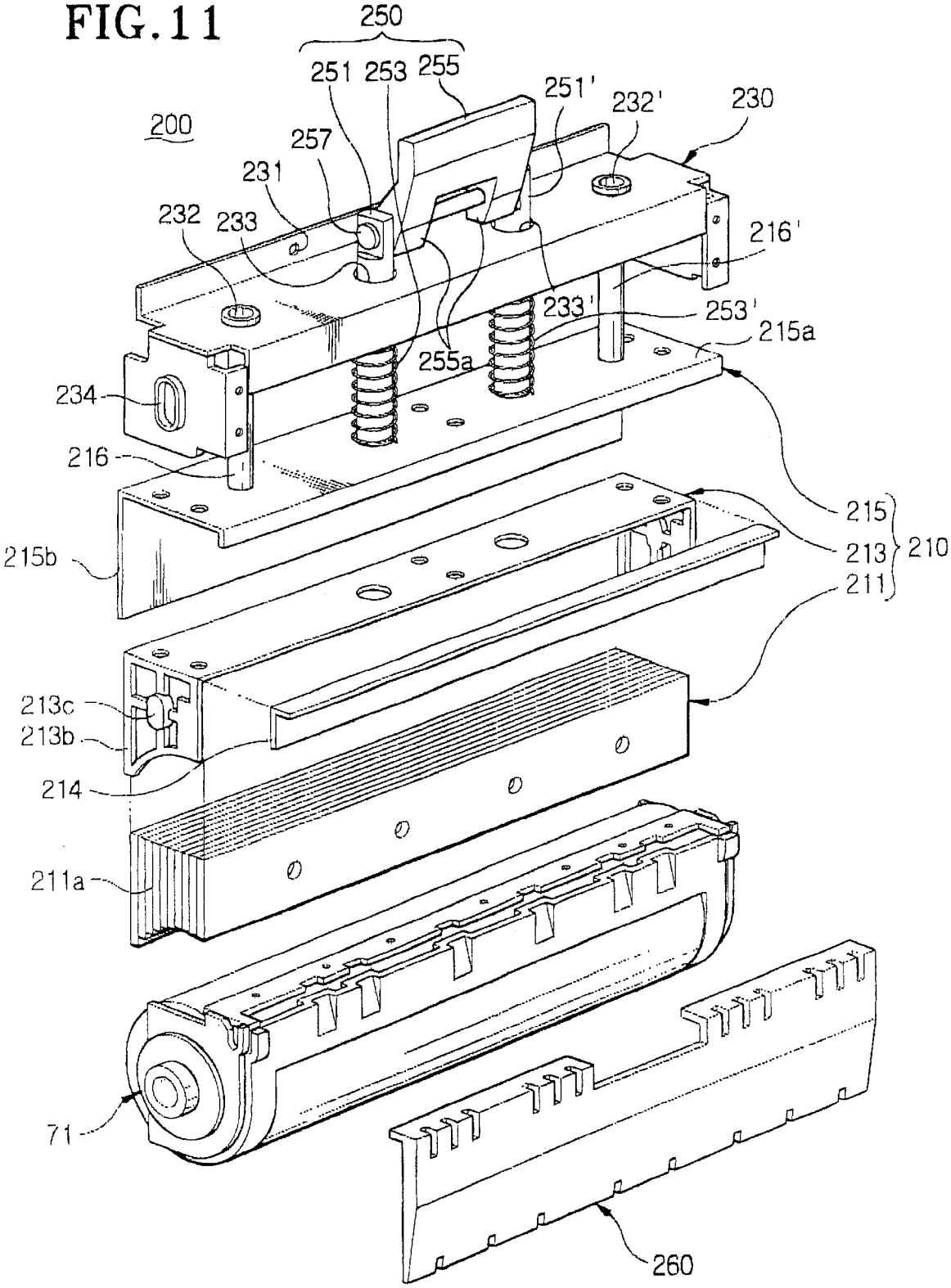
FIG. 11 is an exploded perspective view illustrating the structure of a transfer roller contamination removing means shown in FIG. 2.
Figure 12:
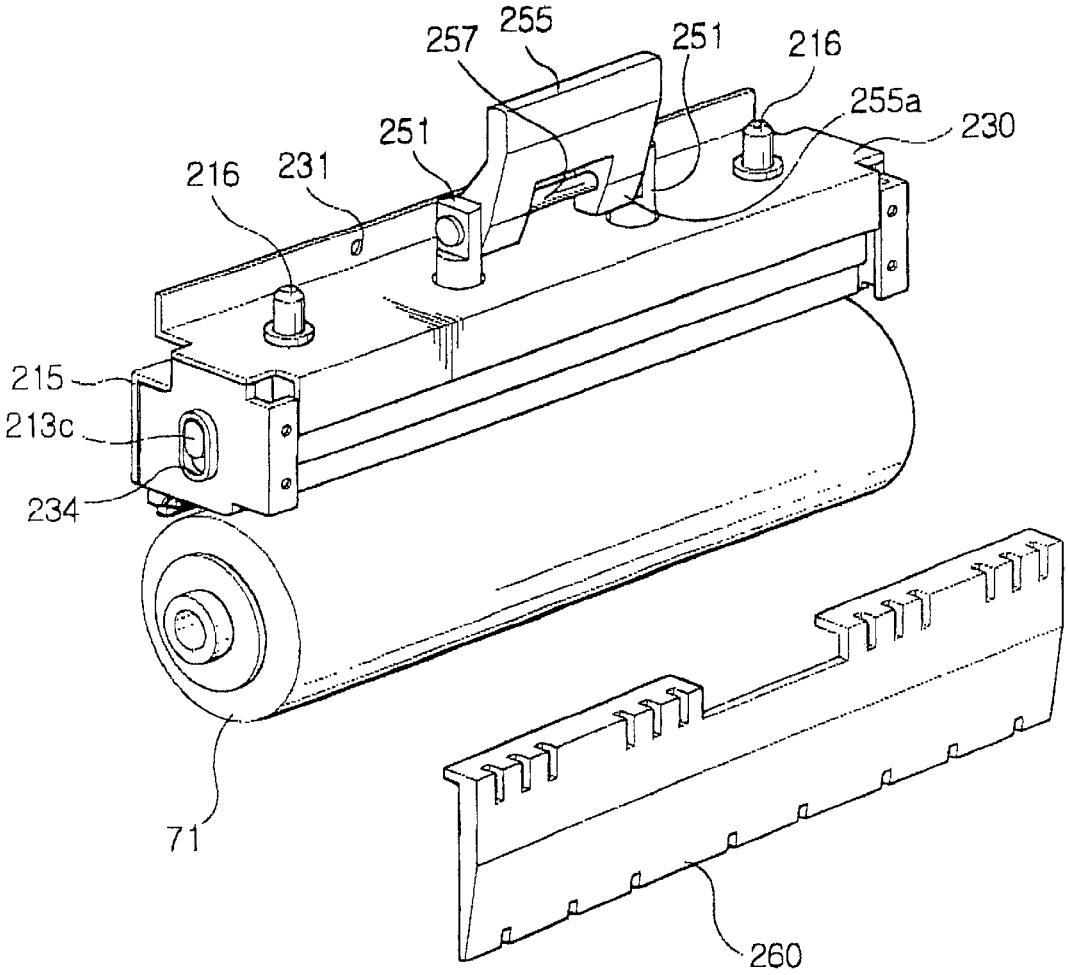
FIG. 12 is a perspective view showing the assembled state of FIG. 11.

FIG. 2 schematically illustrates major parts of a liquid electrophotographic printer 90 employing a cleaning apparatus according to a preferred embodiment of the present invention, FIGS. 3 through 10 illustrate a photoreceptor belt contamination removing means which is one of major parts of the present invention, and FIGS. 11 and 12 illustrate a transfer roller contamination removing means, respectively. In explaining the embodiment of the present invention, the same reference numerals are quoted for the same elements with the prior art in view of structure and function, a detailed explanation thereof will not be given, and only the characteristic parts of the present invention will be described in detail. In the drawings, reference numeral 10 denotes a photoreceptor belt, 20 an erasure unit, 30 a charging unit, 40 an exposure unit, 50 a development unit, 60 a drying unit, 70 a transfer/fixation unit, and 80 a printing sheet. Also, reference numeral 100 denotes a photoreceptor belt contamination removing means, 200 a transfer roller contamination removing means, and 300 a solvent supplying means, respectively.

As shown in FIG. 2, the photoreceptor belt 10 is wound around and supported by rollers 1, 2 and 3 installed in a printer body to and travels around a predetermined track.

The erasure unit 20, the charging unit 30, the exposure unit 40, the development unit 50, the drying unit 60 and the transfer/fixation unit 70 are installed in the neighborhood of the photoreceptor belt 10.

The photoreceptor belt contamination removing means 100 is installed between the erasure unit 20 and the charging unit 30, and serves to remove various contaminants containing untransferred toner which is not transferred to the transfer roller 71 during a transferring process and remains on the photoreceptor belt 10.

The transfer roller contamination removing means 200 is installed next to the transfer roller 71 of the transfer/fixation unit 70, and serves to remove various contaminants containing untransferred toner which is not transferred from the transfer roller 71 to the printing sheet 80 while selectively being in close contact with the transfer roller 71.

The solvent supplying means 300 supplies a solvent to the photoreceptor belt contamination removing means 100 and the transfer roller contamination removing means 200 to allow the respective removing means 100 and 200 to contain the solvent to be used for dissolving and removing untransferred toner, thereby effectively removing various contaminants containing untransferred toner remaining on the photoreceptor belt 10 and the transfer roller 71. In FIG. 2, reference numeral 101 denotes a backup roller.

Now, the construction of the aforementioned cleaning apparatus according to an embodiment of the present invention will be described in detail.

As shown in FIGS. 3 through 10, the photoreceptor belt contamination removing means 100 includes a cleaning member assembly 110 selectively brought into close contact with the surface of the photoreceptor belt 10, a housing 130 for supporting the cleaning member assembly 110, a means 150 for making the cleaning member assembly 110 closely contact and/or separate from the surface of the photoreceptor belt 10 by moving the cleaning member assembly 110 relative to the housing 130, and a frame 170 fixed to the printer body, for detachably supporting the housing 130.

The cleaning member assembly 110 includes a cleaning member 111, a pair of fixing blocks 115 and 115' coupled to both ends of the cleaning member 111, and a bracket 119 integrally coupled to the pair of fixing blocks 115 and 115'.

The cleaning member 111 is formed by stacking a plurality of thin rectangular felts 113 on a fixing plate 112. A cleaning sheet 114 (shown in FIG. 9) in direct contact with the photoreceptor belt 10 during a cleaning operation, is fixed to the bottom of the cleaning member 111. Also, a pair of fixing pieces 112*a* and 112*b* each having a fixation hole are formed at both sides of the fixing plate 112.

The fixing blocks 115 and 115' have fixing parts 115*a* for fixing the fixing pieces 112*a* and 112*b*, respectively. The cleaning member 111 is fixed to the fixing blocks 115 and 115' by screws (not shown) engaged with the fixing holes of the fixing pieces 112*a* and 112*b* and the fixing holes of the fixing parts 115*a* to then be supported, in a state in which the fixing pieces 112*a* and 112*b* are placed in the fixing parts 115*a* of the fixing blocks 115 and 115'. Also, threaded holes 116 and 116' piercing downward are formed on the fixing blocks 115 and 115', respectively. Springs 120 and 120' are inserted into the threaded holes 116 and 116'. The springs 120 and 120' which elastically support the pair of fixing blocks 115 and 115' downward with respect to the housing 130 to make the cleaning member 111 closely contact the surface of the photoreceptor belt 10 with a constant compressive force. Also, adjustment threads 121 and 121' for supporting the springs 120 and 120' inserted thereinto and adjusting the elasticity thereof, are upward engaged with the threaded holes 116 and 116'. Here, the upper portions of the springs 120 and 120' are supported to the housing 130 and the lower portions thereof are supported to flanges 121*a* of the adjustment threads 121 and 121'. Thus, if the adjustment threads 121 and 121' are rotated in forward and reverse directions, they advance and retreat to thus compress or expand the springs 120 and 120' compared to the normal state, by which the compressive force applied to the photoreceptor belt 10 by the cleaning member 111 can be maintained at a constant level by adjusting the elasticity of the springs 120 and 120'. Also, the fixing blocks 115 and 115' have a pair of openings 117 and 117' facing each other at either side of the lower portions thereof, respectively, which will be described later.

The bracket 119 is configured to have a "⊂"-shaped section and is integrally fixed to the fixing blocks 115 and 115' by a plurality of screws (not shown). To this end, a plurality of thread engagement holes 115*b* and 119*a* are formed at locations corresponding to the fixing blocks 115 and 115' and the bracket 119, respectively. Also, the bracket 119 has first throughholes 119*b* formed at locations corresponding to the threaded holes 116 and 116' of the fixing blocks 115 and 115' and second throughholes 119*c* formed in the neighborhood of the first throughholes 119*b*. Here, the springs 120 and 120' pierce first throughholes 19*b* of bracket 119 and pierce threaded holes 116 and 116', respectively, of the fixing blocks 115 and 115', and the second throughholes 119*c* are allowed to expose the fixing parts 115*a* of the fixing blocks 115 and 115' to thus facilitate the screw engagement for fixing the cleaning member 111.

The housing 130 has the shape of a box, the bottom of which is opened, and the cleaning member assembly is accommodated in the inner space thereof to then be supported. A pair of circular holes 131 are formed at both ends of the housing 130, and a plurality of guiding slots 132 are formed on the rear surface of the housing 130 to be spaced a constant distance apart from each other. The circular holes 131 and guiding slots 132 will be described later. Guide rail 133 protrude outwardly along the one end of the housing 130, and a plurality of throughholes 134 for exposing threads (not shown) for assembling the cleaning member 111 and the bracket 119 in the fixing blocks 115 and 115', are formed on the top surface of the housing 130.

The cleaning member contacting/separating means 150 includes a movement shaft 151 installed to be capable of moving axially through the openings 117 and 117' formed on the fixing blocks 115 and 115', a plurality of operating protrusions 152 protruding in the radial direction of the movement shaft 151, and cam grooves 153 each having a predetermined inclined portion are formed on one side of the bracket 119. Here, the movement shaft 151 is fitted into the circular holes 131 formed on the housing 130, and a knob 154 is coupled to one end of the movement shaft 151. The operating protrusions 152 pierce the cam grooves 153 of the bracket 119 to then be inserted in the guiding slots 132 of the housing 130. If a knob 154 is moved, a moving shaft 151 is slid within guiding slots 132. Thus, operating protrusions 152 is moved horizontally and then are in contact with cam grooves 153. A housing 130 is not moved upward and downward but a bracket 119 is moved upward and downward due to the contact between the operating protrusions 152 and the cam grooves 153. Engagement and disengagement of a cleaning member are performed manually by moving the knob 154.

Therefore, if the knob 154 is pushed or pulled by hand, the movement shaft 151 moves axially. Here, the operating protrusions 152 fixed to the shaft 151 pierce the cam grooves 153 of the bracket 119 to then be inserted into the guiding slots 132 of the housing 130, and the movement shaft 151 is inserted into the circular holes 131 of the housing 130. Thus, as the movement shaft 151 moves, the positions of the operating protrusions 152 in the cam grooves 153 are changed so that the bracket 119 ascends or descends in the housing 130 according to the shapes of the cam grooves 153. Here, since the fixing blocks 115 and 115' are coupled to the bracket 119, the cleaning member 111 eventually ascends or descends, so that the cleaning member 111 can closely contact or separate from the surface of the photoreceptor belt 10.

The frame 170 has on its top surface fixing members 171 for fixing the frame 170 to a printer body, and a pair of facing slide grooves 173 formed at both sides of the interior part of the frame 170, for allowing the guide rails 133 of the housing 130 to be inserted thereinto. In other words, the housing 130 can be easily fitted into or pulled out from the frame 170 in a slidable manner.

The transfer roller contamination removing means 200, as shown in FIGS. 11 and 12, includes a cleaning member assembly 210 selectively brought into close contact with the transfer roller 71, a frame 230 fixed to a printer body, for accommodating and supporting the cleaning member assembly 210, and means 250 for making the cleaning member assembly 210 closely contact and/or separate from the transfer roller 71 by moving the cleaning member assembly 210 relative to the frame 230.

The cleaning member assembly 210 includes a cleaning member 211, a holder 213 for accommodating and supporting the cleaning member 211 and a holder bracket 215 integrally coupled to the holder 213.

The cleaning member 211 is formed by stacking a plurality of thin rectangular felts 211*a* such that the heights of the respective felts 211*a* are made different to produce an arcuate lower profile corresponding to the outer circumferential surface of the transfer roller 71.

The holder 213 is constructed such that a pair of vertical parts 213*b* extend from both sides of a horizontal part 213*a*, and guiding protrusions 213*c* are formed on outer sides of the vertical parts 213*b*. A fixing plate 214 is coupled on the front surface of the holder 213.

The holder bracket 215 is substantially of a "]" shape, and a pair of guide bars 216 and 216' protrude at both sides of the horizontal part 215*a*. Here, the vertical parts 215*b* of the holder bracket 215 are positioned on the rear surface of the holder 213 to support the cleaning member 211.

The frame 230 has a plurality of latching holes 231 for fixing the same to the printer body, and a pair of first guiding holes 232 and 232' on the top surface of the frame 230 at constant intervals. The guide bars 216 and 216' of the holder bracket 215 are inserted into the first guiding holes 232 and 232'. Second guiding holes 233 and 233' are formed inside the first guiding holes 232 and 232', and elliptic guiding holes 234 are formed at either side thereof. Guiding protrusions 213*c* formed at either side of the holder 213 are inserted into the elliptic guiding holes 234.

Also, the cleaning member contacting and separating means 250 includes a pair of movement bars 251 and 251' piercing the second guiding holes 233 and 233' to then be fixed to the holder bracket 215 at both ends thereof, springs 253 and 253' interposed between the pair of movement bars 251 and 251', for elastically supporting the holder bracket 215 downward with respect to the frame 230, and a movement lever 255 movably installed to be capable of rotating relative to the movement bars 251 and 251' upward protruding with respect to the frame 230 by means of a pin 257. The movement lever 255 has an operation extension 255*a* having a predetermined height, at the lower portion thereof. Thus, if the movement lever 255 is rotated clockwise when viewed from FIG. 11, the holder bracket 215 is pushed by the distance corresponding to the height of the operation extension 255*a* due to the elasticity of the springs 253 and 253', so that the cleaning member 211 is brought into close contact with the transfer roller 71. If the movement lever 255 is rotated counterclockwise, it erects by pressing the operation extension 255*a* by means of the frame 230. Here, since the frame 230 is fixed so as not to move, the holder bracket 215 installed in the frame 230 so as to move toward the guide bars 216 and 216' is pulled toward the frame 230 by the distance corresponding to the height of the operation extension 255*a* of the movement lever 255, so that the cleaning member 211 separate from the transfer roller 71.

Also, a sheet guide 260 is installed in the frame 230. The sheet guide 260 passes through between the transfer roller 71 and the fixation roller 72 to guide a sheet so as not to be fed between the cleaning member 211 and the transfer roller 71.

The solvent supplying means 300 includes a solvent storage tank 310 installed at one side of the printer body, for storing a solvent, and a solvent conveying member 320 installed to be led from the solvent storage tank 310 to be connected to the photoreceptor belt contamination removing means 100 and the transfer roller contamination removing means 200, for continuously conveying the solvent stored in the solvent storage tank 310 to the cleaning members 111 and 211 of the respective contamination removing means 100 and 200.

Here, the solvent storage tank 310 may be constructed to supply the solvent to the cleaning members 111 and 211 of the respective contamination removing means 100 and 200 using a common tank. Otherwise, there may be two solvent storage tanks corresponding to the respective contamination removing means and. In the case of using a single solvent storage tank, two solvent conveying members are led from the solvent storage tanks to be connected to the respective contamination removing means 100 and 200. Also, in the case of using two solvent storage tanks, the corresponding solvent storage tanks and the respective contamination removing means are mutually connected by means of the solvent conveying members.

The solvent conveying member 320 may be formed of felts, but is not restricted thereto. Also, the same liquid carrier as that contained in the developer liquid may be used as the solvent.

A printing process of a liquid electrophotographic printer employing the cleaning apparatus according to the present invention, will now be described.

The basic printing process is carried out in the similar manner to the printing process performed by the general liquid electrophotographic printer.

That is to say, the printing process is sequentially carried out by performing the following processing steps of: erasing the surface potential of the photoreceptor belt 10 simultaneously when a photoreceptor belt 10 rotates at a predetermined speed, if a printing instruction is input from an external data outputting device such as a computer; charging the photoreceptor belt to a predetermined potential; forming an electrostatic latent image on the charged photoreceptor belt; developing the electrostatic latent image; removing carrier components contained in the developed toner image; and transferring the toner image formed on the photoreceptor belt to a transfer roller to be printed on a printing sheet.

Here, during the transferring/fixing step, the toner image of the photoreceptor belt 10 is not completely transferred to the transfer roller 71 and remains on the photoreceptor belt 10 as contaminants, like in the conventional case. As described above, the untransferred toner remaining on the photoreceptor belt 10 is removed by the photoreceptor belt contamination removing means 100 according to the present invention having the cleaning member 111 closely contacting the photoreceptor belt 10 simultaneously with the printing operation. Also, the image transferred to the transfer roller 71 is completely transferred to the printing sheet 80 and remains on the transfer roller 70 as contaminants. The toner of the transfer roller 71 is removed by the transfer roller contamination removing means 200 installed in the neighborhood of the transfer/fixation roller 70.

In other words, the cleaning member assembly 110 of the photoreceptor belt contamination removing means 100 descends simultaneously with the printing operation, so that the cleaning member 111 is pressed against the photoreceptor belt 10 with a constant pressure and various contaminants containing the untransferred toner of the photoreceptor belt 10 are continuously wiped out. In such a manner, the contaminants of the photoreceptor belt 10 can be removed. Here, since the solvent of the solvent storage tank 310 is continuously supplied to the cleaning member 111, the cleaning member 111 closely contacts the surface of the photoreceptor belt 10 in a state in which it contains the solvent, and removes the contaminants of the photoreceptor belt 10. Thus, the hardened toner on the photoreceptor belt 10 can be effectively removed while being dissolved.

Also, simultaneously with the operation of removing the contaminants of the photoreceptor belt, the cleaning member 211 of the transfer roller contamination removing means 200 is pressed against the transfer roller 71 with a constant pressure to continuously wipe out various contaminants containing untransferred toner of the transfer roller 71. Thus, the contaminants of the transfer roller 71 can be removed. Also, since the solvent is continuously supplied from the solvent storage tank 310 to the cleaning member 211, the toner of the transfer roller 71 can be effectively removed while being dissolved.

The above-described cleaning operation is continuously performed during printing. After printing, the respective cleaning members 111 and 211 are separated from the photoreceptor belt 10 and the transfer roller 71 by a predetermined distance.

As described above, the liquid electrophotographic printer according to the present invention performs printing while continuously removing various contaminants containing untransferred toner remaining on a photoreceptor belt and a transfer roller such that two cleaning members operate during printing. Thus, deterioration of picture quality and print inferiority, which are caused by contaminants containing untransferred toner remaining on the photoreceptor belt and the transfer roller, can be prevented, and a clean picture image can be obtained.

As described above, according to the present invention, various contaminants containing untransferred toner which is not transferred to a transfer roller during a transferring step and remains on a photoreceptor belt, are almost completely removed by a cleaning member closely contacting the photoreceptor belt before a charging step. Also, various contaminants containing untransferred toner which is not transferred from the transfer roller to a printing sheet and remains on the transfer roller, are removed by a cleaning member closely contacting the transfer roller. Thus, deterioration of picture quality and print inferiority, due to contamination of the photoreceptor belt and the transfer roller, can be prevented.

Also, the respective cleaning members according to the present invention contains a solvent supplied from a solvent storage tank and dissolves the contaminants in a state in which they closely contact a photoreceptor belt and a transfer roller, to then be wiped out, thereby effectively removing even hardened toner.

Also, according to the present invention, since a cleaning member closely contacting a photoreceptor belt, continuously cleans the photoreceptor belt simultaneously with a printing operation, a separate cleaning mode and the time required therefor are not necessary. Thus, the overall time required for printing can be reduced, and contamination of the photoreceptor belt can be avoided.

While a preferred embodiment of the invention has been shown and described, it will be appreciated by those skilled in the art that various modifications can be made without departing from the spirit and scope of the invention and all such modifications are intended to be included within the scope of the following claims.

What is claimed is:

1. A cleaning apparatus of a liquid electrophotographic printer, comprising:

a photoreceptor belt cleaner installed between a transfer/fixation unit and a charging unit in the neighborhood of a photoreceptor belt of the liquid electrophotographic printer to be brought into close contact with a surface of the photoreceptor belt simultaneously with a printing operation, for removing contaminants containing untransferred toner on the photoreceptor belt;

a transfer roller cleaner installed in the neighborhood of the transfer/fixation unit to be brought into close contact with the surface of a transfer roller simultaneously with a printing operation, for removing contaminants containing untransferred toner on the transfer roller; and a solvent supplier continuously supplying a solvent to the photoreceptor belt cleaner and the transfer roller cleaner so that the respective cleaners containing the solvent dissolve the untransferred toner, wherein the photoreceptor belt cleaner comprises:

a cleaning member assembly selectively brought into close contact with the surface of the photoreceptor belt, for wiping out contaminants of the photoreceptor belt;

a housing for supporting the cleaning member assembly;

a slidable mechanism allowing the cleaning member assembly to either closely contact or to separate from the surface of the photoreceptor belt by moving the cleaning member assembly relative to the housing; and a frame fixed to the printer body, for detachably supporting the housing, wherein the cleaning member assembly comprises:

a cleaning member formed by stacking a plurality of thin rectangular felts on a fixing plate having a pair of fixing pieces, and having a cleaning sheet fixed to the bottom surface of the stack of the felts which is brought into direct contact with the photoreceptor belt during a cleaning operation;

a pair of fixing blocks coupled to both ends of the cleaning member and having fixing parts for fixing the fixing pieces of the cleaning member, respectively, and threaded holes piercing downward;

a holder bracket integrally coupled to the pair of fixing blocks;

springs installed in the threaded holes of the fixing blocks, for elastically supporting the pair of fixing blocks downward with respect to the housing; and adjustment threads upwardly engaged with the threaded holes, for supporting the springs and adjusting the elasticity thereof.

2. The cleaning apparatus according to claim 1, wherein the slidable mechanism comprises:

a movement shaft installed to be capable of moving axially through the openings formed on the fixing blocks;

a plurality of operating protrusions protruding at three or more locations of the movement shaft in the radial direction thereof; and cam grooves each having a predetermined inclined portion, formed on one side of the holder bracket, wherein the cleaning member assembly ascends or descends with respect to the housing by the action of the operating protrusions and the cam grooves of the holder bracket by moving the movement shaft axially.

3. The cleaning apparatus according to claim 1, wherein the solvent supplier comprises:

at least one solvent storage tank installed at one side of the printer body, for storing a solvent; and a solvent conveying member installed to be led from the solvent storage tank to be connected to the photoreceptor belt cleaner and the transfer roller cleaner, for continuously conveying the solvent stored in the solvent storage tank to the respective cleaners.

4. A cleaning apparatus of a liquid electrophotographic printer, comprising:

a photoreceptor belt cleaner installed between a transfer/fixation unit and a charging unit in the neighborhood of a photoreceptor belt of the liquid electrophotographic printer to be brought into close contact with a surface of the photoreceptor belt simultaneously with a printing operation, for removing contaminants containing untransferred toner on the photoreceptor belt;

a transfer roller cleaner installed in the neighborhood of the transfer/fixation unit to be brought into close contact with the surface of a transfer roller simultaneously with a printing operation, for removing contaminants containing untransferred toner on the transfer roller; and a solvent supplier continuously supplying a solvent to the photoreceptor belt cleaner and the transfer roller cleaner so that the respective cleaners saturated by the solvent dissolve the untransferred toner, wherein the transfer roller cleaner comprises:

a cleaning member assembly selectively brought into close contact with the transfer roller, for wiping out the contaminants of the transfer roller;

a frame fixed to a printer body and having a pair of first guiding holes and having a pair of second guiding holes formed on its top surface and a pair of lateral guiding holes formed at either lateral side thereof, for supporting the cleaning member assembly; and a clamp allowing the cleaning member assembly either to closely contact the transfer roller or to separate away from the transfer roller by moving the cleaning member assembly relative to the frame.

5. The cleaning apparatus according to claim 4, wherein the cleaning member assembly comprises:

a cleaning member formed by stacking a plurality of thin rectangular felts having different heights and having an arcuate lower profile corresponding to the outer circumferential surface of the transfer roller disposed under the stack of the felts;

a holder for fixing the cleaning member and having guiding protrusions inserted into said pair of lateral guiding holes of the frame; and a holder bracket integrally coupled to the holder and having on the top surface thereof a pair of guide bars piercing a pair of first guiding holes formed on the frame.

6. The cleaning apparatus according to claim 4, wherein said clamp comprises:

a pair of movement bars piercing the pair of second guiding holes formed in the frame to then be fixed to the holder bracket;

a pair of springs interposed between respective ones of the pair of movement bars, for elastically supporting the holder bracket downward with respect to the frame; and a movement lever movably installed to be capable of rotating relative to the movement bars upward protruding with respect to the frame by a pin, and having an operation extension having a predetermined height, at the lower portion thereof.

7. The cleaning apparatus according to claim 4, wherein a sheet guide for guiding ejected sheets is installed in the frame.

8. The cleaning apparatus according to claim 4, wherein the solvent supplier comprises:

at least one solvent storage tank installed at one side of the printer body, for storing a solvent; and a solvent conveying member installed to be led from the solvent storage tank to be connected to the photoreceptor belt cleaner and the transfer roller cleaner, for continuously conveying the solvent stored in the solvent storage tank to the respective cleaners.

9. A liquid electrophotographic printer, comprising:

a photoreceptor belt wound around and supported by a plurality of rollers which are installed within a printer body and traveling along a predetermined track;

a charging unit for charging the surface potential erased photoreceptor belt to a predetermined potential;

an exposure unit for forming an electrostatic latent image on the photoreceptor belt by scanning onto the photoreceptor belt a laser beam converted according to electric data of a portion to be printed;

a development unit for supplying a developer liquid which is a mixture of solid toner and liquid carrier to the photoreceptor belt to adhere the toner to a portion on the surface of the photoreceptor belt where the electrostatic latent image is formed, thereby forming a visible image;

a drying unit for absorbing, drying and removing only the carrier contained in the developer liquid other than the toner adhered to the photoreceptor belt;

a transfer/fixation unit for transferring the toner formed on the photoreceptor belt as an image to a printing sheet;

a photoreceptor belt cleaning unit installed between a transfer/fixation unit and a charging unit in the neighborhood of a photoreceptor belt of the liquid electrophotographic printer to be brought into close contact with the surface of the photoreceptor belt simultaneously with a printing operation, for removing contaminants containing untransferred toner left on the photoreceptor belt;

a transfer roller cleaning unit installed in the neighborhood of the transfer/fixation unit to be brought into close contact with the surface of the transfer roller simultaneously with a printing operation, for removing contaminants containing untransferred toner left on the transfer roller; and a solvent supplier for continuously supplying a solvent to the photoreceptor belt cleaning unit and the transfer roller cleaning unit so that each cleaning unit contains the solvent to dissolve the untransferred toner, wherein the photoreceptor belt cleaning unit comprises:

a cleaning member assembly selectively brought into close contact with the surface of the photoreceptor belt, for wiping out the contaminants of the photoreceptor belt;

a housing for supporting the cleaning member assembly;

a slidable mechanism allowing the cleaning member assembly to either closely contact or separate from the surface of the photoreceptor belt by moving the cleaning member assembly relative to the housing; and a frame fixed to a printer body, for detachably supporting the housing, wherein the cleaning member assembly comprises:

a cleaning member formed by stacking a plurality of thin rectangular felts on a fixing plate having a pair of fixing pieces, and having a cleaning sheet fixed to the bottom surface of the stack of the felts which is brought into direct contact with the photoreceptor belt during a cleaning operation;

a pair of fixing blocks coupled to both ends of the cleaning member and having fixing parts for fixing the fixing pieces of the cleaning member, respectively, and threaded holes piercing downward;

a holder bracket integrally coupled to the pair of fixing blocks;

a pair of springs installed in respective threaded holes of the fixing blocks, elastically supporting the pair of fixing blocks downward with respect to the housing; and adjustment threads upwardly engaged with the threaded holes, supporting the springs and adjusting the elasticity thereof.

10. The liquid electrophotographic printer according to claim 9, wherein said slidable mechanism comprises:

a movement shaft installed to be capable of moving axially through the openings formed on the fixing blocks;

a plurality of operating protrusions protruding at three or more locations of the movement shaft in the radial direction thereof, and cam grooves each having a predetermined inclined portion, formed on one side of the holder bracket, wherein the cleaning member assembly ascends or descends with respect to the housing by the action of the operating protrusions and the cam grooves of the holder bracket by moving the movement shaft axially.

11. The liquid electrophotographic printer according to claim 9, wherein the solvent supplier comprises:

at least one solvent storage tank installed at one side of the printer body, for storing a solvent; and a solvent conveying member installed to be led from the solvent storage tank to be connected to the photoreceptor belt cleaning unit and the transfer roller cleaning unit, for continuously conveying the solvent stored in the solvent storage tank to the respective cleaning units.

12. A liquid electrophotographic printer, comprising:

a photoreceptor belt wound around and supported by a plurality of rollers which are installed within a printer body and traveling along a predetermined track;

a charging unit for charging the surface potential erased photoreceptor belt to a predetermined potential;

an exposure unit for forming an electrostatic latent image on the photoreceptor belt by scanning onto the photoreceptor belt a laser beam converted according to electric data of a portion to be printed;

a development unit for supplying a developer liquid which is a mixture of solid toner and liquid carrier to the photoreceptor belt to adhere the toner to a portion on the surface of the photoreceptor belt where the electrostatic latent image is formed, thereby forming a visible image;

a drying unit for absorbing, drying and removing only the carrier contained in the developer liquid other than the toner adhered to the photoreceptor belt;

a transfer/fixation unit for transferring the toner formed on the photoreceptor belt as an image to a printing sheet;

a photoreceptor belt cleaning unit installed between a transfer/fixation unit and a charging unit in the neighborhood of a photoreceptor belt of the liquid electrophotographic printer to be brought into close contact with the surface of the photoreceptor belt simultaneously with a printing operation, for removing contaminants containing untransferred toner left on the photoreceptor belt;

a transfer roller cleaning unit installed in the neighborhood of the transfer/fixation unit to be brought into close contact with the surface of the transfer roller simultaneously with a printing operation, for removing contaminants containing untransferred toner left on the transfer roller; and a solvent supplier for continuously supplying a solvent to the photoreceptor belt cleaning unit and the transfer roller cleaning unit so that each cleaning unit contains the solvent to dissolve the untransferred toner, wherein the transfer roller cleaning unit comprises:

a cleaning member assembly selectively brought into close contact with the transfer roller, for wiping out the contaminants of the transfer roller;

a frame fixed to a printer body and having each pair of first and second guiding holes formed on its top surface and a pair of lateral guiding holes formed at either lateral side thereof, for supporting the cleaning member assembly; and a clamp allowing the cleaning member assembly either closely contact the transfer roller or separate from the transfer roller by moving the cleaning member assembly relative to the frame.

13. The liquid electrophotographic printer according to claim 12, wherein the cleaning member assembly comprises:

a cleaning member formed by stacking a plurality of thin rectangular felts having different heights and having an arcuate lower profile corresponding to the outer circumferential surface of the transfer roller disposed under the stack of the felts;

a holder for fixing the cleaning member and having guiding protrusions inserted into said pair of lateral guiding holes of the frame; and a holder bracket integrally coupled to the holder and having on its top surface a pair of guide bars piercing a pair of first guiding holes formed on the frame.

14. The liquid electrophotographic printer according to claim 12, wherein said clamp comprises:

a pair of movement bars piercing the second guiding holes to then be fixed to the holder bracket at both ends thereof;

a pair of springs interposed between respective ones of said pair of movement bars, for elastically supporting the holder bracket downward with respect to the frame; and a movement lever movably installed to be capable of rotating relative to the movement bars upward protruding with respect to the frame by a pin, and having an operation extension having a predetermined height, at the lower portion thereof.

15. The liquid electrophotographic printer according to claim 12, wherein a sheet guide for guiding ejected sheets is installed in the frame.

16. The liquid electrophotographic printer according to claim 12, wherein the solvent supplier comprises:

at least one solvent storage tank installed at one side of the printer body, for storing a solvent; and a solvent conveying member installed to be led from the solvent storage tank to be connected to the photoreceptor belt cleaning unit and the transfer roller cleaning unit, for continuously conveying the solvent stored in the solvent storage tank to the respective cleaning units.

* * * * *